United States Patent [19]

Viehrig et al.

[11] 4,218,123

[45] Aug. 19, 1980

[54] MACHINE FOR DEVELOPING PHOTOGRAPHIC PAPER OR THE LIKE

[75] Inventors: Wolfgang Viehrig; Werner Sperber, both of Munich, Fed. Rep. of Germany

[73] Assignee: AGFA-Gevaert, A.G., Leverkusen, Fed. Rep. of Germany

[21] Appl. No.: 953,757

[22] Filed: Oct. 23, 1978

[30] Foreign Application Priority Data

Oct. 28, 1977 [DE] Fed. Rep. of Germany ..... 2748480

[51] Int. Cl.[2] ..... G03D 16/06

[52] U.S. Cl. ..... 354/310; 354/319; 242/71.1

[58] Field of Search ..... 354/277, 297, 307, 310, 354/311, 312, 313, 314, 319, 320; 352/75, 76, 78 R; 242/71.1, 197

[56] References Cited

U.S. PATENT DOCUMENTS

| | | | |
|---|---|---|---|
| 3,195,438 | 7/1965 | Woodcock | 354/310 |
| 3,568,587 | 3/1971 | Vaval | 354/310 |
| 3,627,227 | 12/1971 | Foor | 242/197 |
| 3,766,483 | 12/1973 | Reitter | 352/78 R |
| 3,879,030 | 4/1975 | Hommerin | 354/319 |
| 4,067,034 | 1/1978 | Kwiatkowski | 354/319 |

*Primary Examiner*—L. T. Hix
*Assistant Examiner*—Alan Mathews
*Attorney, Agent, or Firm*—Peter K. Kontler

[57] ABSTRACT

Apparatus for introducing the leaders of webs of exposed photographic paper which is confined in cassettes into a dark chamber preparatory to threading of webs through a developing machine has a feed table with a channel for admission of webs into the chamber and an adapter with an open-and-shut housing for cassettes of different sizes. One section of the housing is separably mounted on the feed table and has an aperture in register with the channel as well as a pair of advancing rolls which lighttightly seal the internal compartment of the housing from the aperture and can be driven in opposite directions to advance the leader of a web into and through the channel. Another section of the housing is pivotable between open and closed positions to respectively afford access to and to lighttightly seal the internal compartment. The one section has pairs of internal platforms serving as supports for differently dimensioned cassettes.

20 Claims, 2 Drawing Figures

10'
19'
12
2
11
8
18'
II
18b
II
1B
G
19B
6
19A
20
16A
16
16B
14
15A
3
15
15B
7
19D
19B
1A
19
10
21
17b
9
1
5
13
13A
4

MACHINE FOR DEVELOPING PHOTOGRAPHIC PAPER OR THE LIKE

BACKGROUND OF THE INVENTION

The present invention relates to developing machines for exposed photosensitive material, especially convoluted webs of exposed photographic paper. More particularly, the invention relates to improvements in apparatus for processing cassettes for webs of exposed photosensitive material and their contents prior to introduction into the developing unit proper of a photographic developing machine.

In presently known developing machines for photographic paper (examples of such machines are so-called LABOMATOR 5 ZOLL machines manufactured by the assignee of the present application), a cassette which contains a supply of convoluted exposed photographic paper web is placed onto a feed table and the leader of the web (such leader extends from the cassette) is advanced through a channel in the feed table and into a dark chamber below the feed table where the leader is clamped to a threading strip or pull tape. The latter serves to advance the leader through the tanks of a developing machine. A drawback of presently known apparatus for processing cassettes which contain exposed photographic paper or the like is that cassettes of varying sizes cannot be alternately positioned at one and the same location above the feed table. The term "varying sizes" is intended to denote all dimensions or parameters of cassettes for webs of different lengths and/or widths. Attempts to enchange the versatility of conventional apparatus include the provision of several feed tables each having a channel or infeed passage of different length, namely, a channel which permits the passage of a web having a given width. Thus, if a first cassette containing a supply of relatively narrow web is to be followed by a cassette which stores a supply of wider web, the previously used feed table must be replaced with a different feed table. This is a time-consuming operation and the supply of spare feed tables occupies a substantial amount of space. Moreover, frequent replacement of feed tables enhances the wear upon their edges and other portions so that such tables are likely to permit light to penetrate into the chamber therebelow after a relatively short interval of use. The same applies for sealing element (e.g., elastic light-intercepting lips or the like) which are normally interposed between an interchangeable feed table and its support.

OBJECTS AND SUMMARY OF THE INVENTION

An object of the invention is to provide a novel and improved apparatus which can manipulate containers or cassettes prior to withdrawal of exposed photosensitive material from the cassettes preparatory to introduction into the tanks of a developing machine.

Another object of the invention is to provide an apparatus whose versatility greatly exceeds the versatility of heretofore known apparatus and which can readily accept and process large or small, wide or narrow, short and/or long cassettes for exposed photographic material, especially for convoluted webs of exposed photographic paper.

A further object of the invention is to provide an apparatus of the above outlined character which can prevent, for extended periods of time, the penetration of outside light into the space or spaces where the exposed frames of photographic material could be affected by light.

An additional object of the invention is to provide an apparatus wherein differently dimensioned and/or configurated cassettes for exposed photographic material can be processed one after the other without any adjustments and wherein one and the same feed table can be used at all times, regardless of the size and/or shape of cassettes whose contents are to be introduced into the developing machine.

Another object of the invention is to provide a novel and improved receptacle or housing for cassettes which can be used in an apparatus of the above outlined character.

An ancillary object of the invention is to provide the apparatus with novel and improved means for preventing uncontrolled entry of light into the space or spaces where the exposed frames of photosensitive material could be affected by outside light.

The invention is embodied in a machine for developing exposed photographic paper or like webs of photosensitive material which is stored in containers or cassettes. More particularly, the invention is embodied in an apparatus which serves to withdraw webs from cassettes preparatory to introduction of webs into the developing machine proper. The apparatus comprises a feed table or an analogous support which has a channel for the passage of a web therethrough, means defining a chamber at one side (e.g., at the underside) of the feed table, and an adapter which is adjacent to the other side of the feed table and comprises an openable receptacle or housing which has an aperture in communication with the chamber and defines a compartment for reception of cassettes having different dimensions. Each differently dimensioned cassette normally stores a supply of convoluted web having a given length and/or width.

The feed table and/or the adapter is preferably provided with brackets, plates or other suitable means for locating the housing with respect to the table in such position that the aperture of the housing registers with the channel. Furthermore, the housing and/or the feed table comprises or carries a reciprocable gate or other suitable means for sealing the channel from the chamber; the adapter then preferably comprises one or more projections in the form of pins or the like for retracting the gate so as to permit a web to enter the chamber via channel in the feed table when the housing of the adapter is engaged and properly positioned by the locating means.

The housing preferably comprises a plurality of sections (e.g., two sections which are pivotally connected to each other) at least one of which is movable to and from an open position to thereby permit insertion of a selected cassette into or to permit removal of such cassette from the compartment. In accordance with a presently preferred embodiment, the housing of the adapter comprises a first or lower section which is separably mounted on the feed table and a second or upper section which is movable with respect to the first section between open and closed positions to respectively afford access to and to lighttightly seal the compartment. The aforementioned aperture is provided in the first or lower section, and the latter is preferably further provided with means for centering the housing with respect to the feed table as well as with means for retracting the aforementioned gate when the first section is properly mounted on the feed table. The centering means may but need not constitute the retracting means. Suitable sealing means is preferably interposed between the first section and the feed table to prevent penetration of light from the area surrounding the first section into the aperture and/or channel, i.e., into the chamber at the underside of the feed table. Further sealing means (e.g., one or more labyrinth seals) can be provided on the first and/or second section to prevent penetration of light into the compartment when the second section is moved to its closed position.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
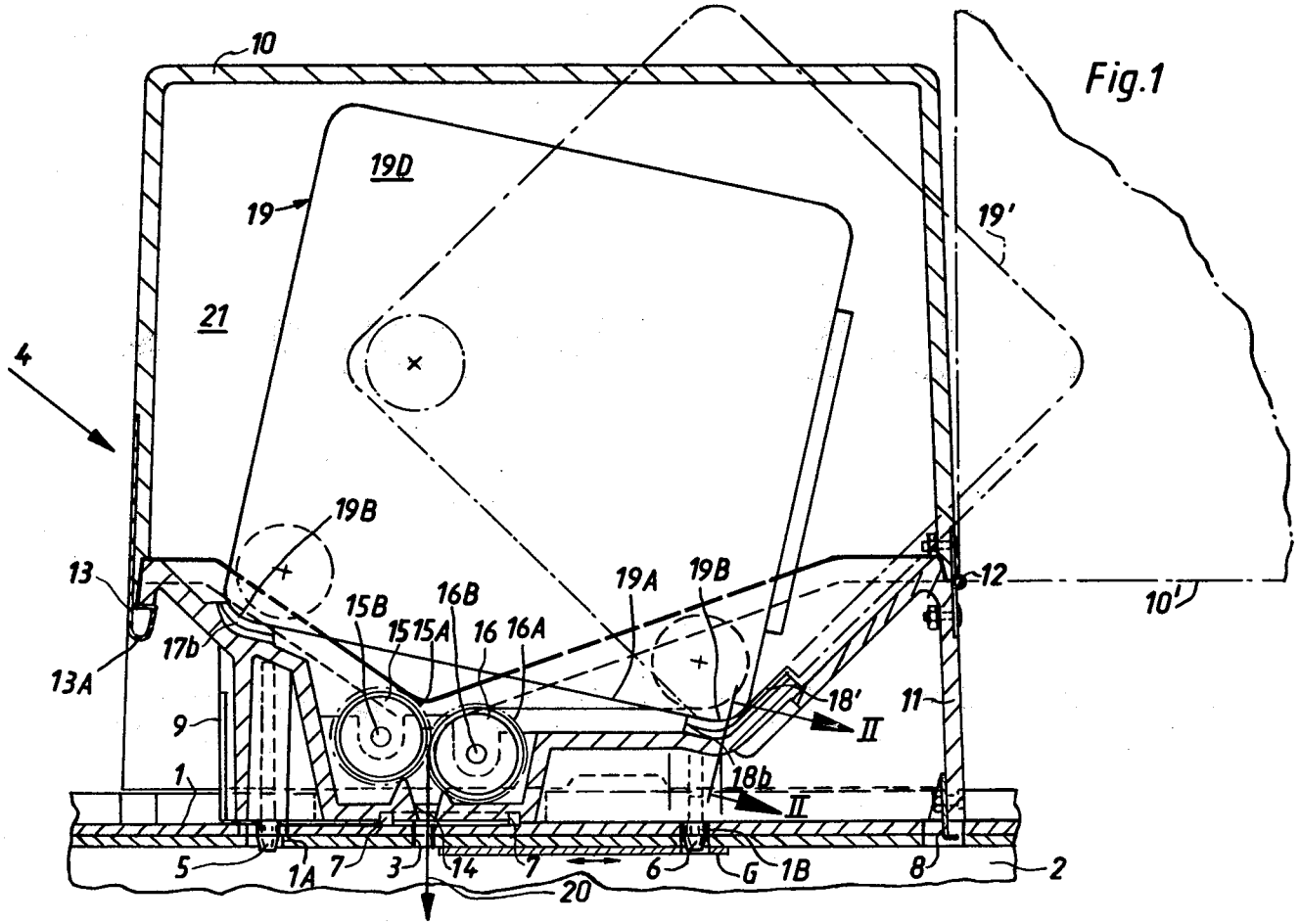
FIG. 1 is a somewhat schematic fragmentary partly vertically sectional view of an apparatus which embodies one form of the invention, the open position of the second section of the adapter housing and an intermediate position of a cassette for a supply of exposed photographic paper being indicated by phantom lines.

The apparatus which is shown in the drawing forms part of or is installed in or on a developing machine for exposed photographic paper or the like. A container or cassette 19 which contains a supply or convoluted exposed photosensitive web material can be inserted into an adapter or receptacle 4 which is constructed, assembled and mounted in accordance with a feature of the invention. The adapter 4 has a housing including a first or lower section 11 and a second or upper section 10 which is movable between an open position 10' (indicated by phantom lines) and a closed position which is shown by solid lines. When the section 10 is moved to the closed position, it defines with the section 11 a compartment 21 which airtightly confines the inserted cassette 19. To this end, the abutting edge faces of the sections 10 and 11 are provided with one or more sealing devices, e.g., one or more labyrinth seals. The illustrated labyrinth seal comprises an elastically deformable male sealing element 13 which is provided on the edge faces of the section 10 and extends into a complementary socket 13A in the adjacent edge faces of the section 11.

The housing 10, 11 of the adapter 4 is separably mounted at the upper side of a substantially horizontal feed table or support 1 which is formed with an elongated channel 3 (extending at right angles to the plane of FIG. 1) communicating with a chamber 2 which is adjacent to the underside of the feed table 1 and is normally sealed against entry of light into its interior. The leader of a web which is withdrawn from the cassette 19 in the compartment 21 and is advanced into the chamber 2 via channel 3 is clamped or otherwise secured to a strip or tape which advances the web through the tanks of the developing machine. The manner in which the web is clamped to a strip or tape in the chamber 2 or is otherwise caused to advance through the developing machine proper forms no part of the present invention.

The lower section 11 of the housing 10, 11 of the adapter 4 is separably mounted on the feed table 1. To this end, the feed table 1 comprises locating means including a bracket 8 and a sheet metal plate 9 to insure that the section 11 is located and held in a predetermined optimum position in which its downwardly tapering wedge-like aperture 14 registers with the upper end of the channel 3 in the feed table 1. The outer side of the section 11 carries or is made integral with two centering or positioning pins 5 and 6 extending into complementary openings or sockets 1A, 1B of the feed table 1. At least one of the pins 5 and 6 further performs an additional function, namely, to retract a reciprocable gate G which is mounted at the underside of or in the feed table 1 and serves to normally seal the chamber 2 against entry of light via channel 3. When the section 11 is properly located by the bracket 8 and plate 9, and the pins 5 and 6 respectively extend into the corresponding sockets 1A and 1B, one of the pins (e.g., the pin 6) maintains the gate G in the illustrated retracted position in which the leader 20 of a web can be introduced into the chamber 2 via aperture 14 and channel 3. The gate G may constitute a sophisticated shutter or a simple plate or flap which is movable in the directions indicated by arrow between an operative position below the channel 3 and the illustrated retracted position. One mode of moving the gate with respect to the feed table is disclosed in the commonly owned U.S. Pat. No. 4,067,034 granted Jan. 3, 1978 to Kwiatkowski. The disclosure of this patent is incorporated herein by reference.

Elastic sealing elements 7 in the form of rubber strips or lips are recessed into the outer side of the section 11 and/or into the upper side of the feed table 1 so as to seal the gap (if any) between the parts 1 and 11 against the penetration of daylight or artificial light from the area surrounding the section 11 into the channel 3 and thence into the chamber 2 and/or aperture 14.

The upper section 10 of the housing of the adapter 4 is pivotally connected to the rear upper portion of the lower section 11 by one or more hinges 12 which enable an attendant to pivot the section 10 between the aforediscussed open and closed positions. The lower section 11 contains two web-advancing rolls 15 and 16 which constitute a means for sealing the upper end of the aperture 14 against penetration of light from the compartment 21 and whose nip is in register with the aperture 14 so that the leader 20 of a web which is inserted between the rolls 15, 16 is compelled to advance downwardly, as viewed in FIG. 1, i.e., through the aperture 14 and channel 3 and into the interior of the chamber 2. As shown, portions of the advancing rolls 15 and 16 are recessed into the bottom portion of the section 11. The means for rotating the rolls 15, 16 in opposite directions and without slippage comprises two mating gears 15A, 16A which are respectively mounted on the shafts 15B, 16B of the rolls 15 and 16. Absence of slippage between the peripheral surfaces of the rolls 15, 16 is desirable in order to avoid damage to the emulsion-coated side of the web which advances into the chamber 2 when the rolls 15, 16 are driven to respectively rotate in clockwise and counterclockwise directions. The axes of the advancing rolls 15 and 16 are parallel to the longitudinal directions of the aperture 14 and channel 3.

Figure 2:
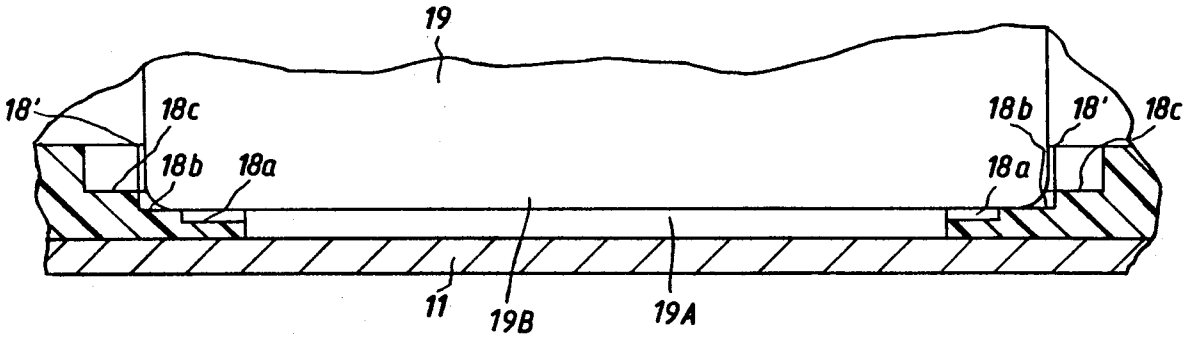
FIG. 2 is an enlarged fragmentary transverse sectional view as seen in the direction of arrows from the line II—II of FIG. 1.

The lower section 11 of the housing 10, 11 of the adapter 4 is further provided with internal positioning means for cassettes of different sizes and/or shapes. Such positioning means include pairs or sets of two-part front and rear platforms. As shown in FIG. 2, the rear portion of the section 11 has three two-part rear platforms 18*a*, 18*b*, 18*c* and the front portion of the section 11 has three two-part front platforms (one shown in FIG. 1, as at 17*b*). A cassette 19 having a side face 19A of medium width rests on the platforms 17*b*, 18*b*. These platforms have concave cassette-contacting surfaces (see FIG. 1 which shows the concave surfaces of the platforms 17*b*, 18*b*) with radii of curvature which match or approximate the radii of rounded end portions 19B of the side face 19A of the respective cassette 19. A wider cassette will come to rest on the platform 18*c* and the corresponding front platform, and a narrower cassette will come to rest on the platform 18*a* and the corresponding front platform. In each instance, the slot for evacuation of exposed web material from a properly inserted cassette is located at a level above the nip of the advancing rolls 15 and 16. The surfaces of the rear platforms 18*a*–18*c* preferably slope rearwardly and outwardly (this is shown in FIG. 1, as at 18′, for the surface of the platform 18*b*) so as to enable an attendant to insert a cassette in the phantom-line tilted position 19′ of FIG. 1, to withdraw a requisite length of the leader 20 of the confined web from the cassette in the position 19′, and to thereupon pivot the cassette to the solid-line position 19 of FIG. 1 so that the leader 20 of the web enters the nip of the rolls 15, 16 or abuts against one of these rolls to be introduced into the nip as soon as the shaft 15B and/or 16B receives torque from a suitable prime mover in order to drive the roll 15 clockwise whereby the roll 16 automatically rotates counterclockwise or to drive the roll 16 counterclockwise so that the roll 15 is compelled to rotate clockwise.

It goes without saying that the section 11 of the housing 10, 11 of the adapter 4 can be provided with a single platform at its front or rear end and with several platforms at its rear or front end. The single platform then supports the corresponding end of the side face of a longer, shorter or medium long cassette. The construction which is shown in FIG. 2 and which further includes three two-part front platforms is preferred at this time because it allows for even more accurate positioning of larger, smaller or medium-sized cassettes in the compartment 21. It is further clear that the section 11 can be provided with only two sets of platforms or with four or more sets of platforms, depending on the contemplated number of different cassettes which are to be processed in the apparatus.

The section 10 and/or 11 of the housing of the adapter 4 may be made of polyurethane foam or another suitable synthetic plastic material. However, the sections of the adapter housing may also consist, at least in part, of a material other than a synthetic plastic substance, e.g., a metallic material.

The operation is as follows:

It is assumed that the adapter 4 is detached from the feed table 1. Therefore, and since the socket 1B does not receive a pin 6, the gate G is held in the operative or light-intercepting position (e.g., under the action of one or more springs as disclosed in U.S. Pat. No. 4,067,034) to seal the channel 3 from the interior of the chamber 2. When the apparatus is to be put to use, an empty adapter 4 is placed onto the table 1 in such a way that the section 11 of its housing is properly located by the bracket 8 and plate 9, i.e., the aperture 14 registers with the channel 3. The pins 5 and 6 center the adapter 4 on the feed table 1 (such centering action is in addition to that which is furnished by the locating means 8 and 9), and the pin 6 retracts the gate G so that the channel 3 and the aperture 14 are free to communicate with the interior of the chamber 2. This does not result in admission of light into the chamber 2 because the rolls 15 and 16 establish a lighttight seal above the upper end of the aperture 14. The sealing elements 7 prevent entry of daylight or artificial light from the area around the section 11 into the channel 3 and/or chamber 2.

The attendant thereupon pivots the upper section 10 to the open position 10′ by overcoming the frictional engagement between the components 13, 13A of sealing means along the abutting edge faces of the sections 10 and 11. Thus, the compartment 21 is exposed and the attendant can insert a selected cassette 19. The insertion is preferably carried out in such a way that the corresponding end portion (19B) of a side face (19A) of the selected cassette 19 is first placed onto the rear platform (18*b*) while the cassette assumes the phantom-line position 19′. The leader 20 of the web extends from the cassette 19 so that the exposed part of the leader 20 can be grasped by fingers and inserted into the nip of the advancing rolls 15 and 16. The cassette 19 is then placed onto the corresponding front platform (17*b*) and the upper section 10 is pivoted back to the closed position so that the labyrinth seal 13, 13A prevents penetration of outside light into the compartment 21. The advancing rolls 15, 16 are driven continuously or in response to movement of the section 10 to the closed position whereby the leader 20 of the web advances through the aperture 14 and channel 3 and into the interior of the chamber 2 to be clamped or otherwise secured to a threading strip or tape. The direction in which the web advances in response to rotation of the advancing rolls 15 and 16 is indicated in FIG. 1 by the arrow at the end of the leader 20. The manner in which the leader 20 of the web can be clamped or otherwise secured to a threading tape is disclosed, in the aforementioned U.S. Pat. No. 4,067,034. The rolls 15, 16 continue to draw the web from the interior of the cassette 19 in the compartment 21 after the leader 20 of the web is clamped to the threading tape.

If the curvature of both end portions 19B of a side face 19A of the cassette 19 is the same, the cassette can be inserted into the compartment 21 in the illustrated position or in the inverted position, i.e., turned through 180 degrees so that the other major panel of the cassette faces the observer of FIG. 1. This can also be achieved by appropriate configuration of surfaces bounding the front platforms and the rear platforms 18*a*–18*c*. The feature that a cassette can be inserted into the adapter 4 in two different positions (at 180 degrees with respect to each other) is desirable and advantageous because this enables the attendant to invariably insert the cassette in such a way that the emulsion-coated surface of the withdrawn web faces in a predetemined direction, e.g., in a direction to the right, as viewed in FIG. 1. It happens quite frequently that a cassette contains a supply of exposed photographic paper wherein the emulsion-coated side faces outwardly, and that another cassette contains a supply of exposed paper wherein the emulsion-coated side faces inwardly. The improved adapter 4 can properly receive both types of cassettes to thus insure that the emulsion-coated side always faces in the desired direction when the web is transported through the tanks of the developing machine. Heretofore known apparatus are incapable of insuring proper orientation of the emulsion-coated side of a web if the emulsion-coated side faces in a direction other than the emulsion-coated sides of webs in other containers.

An important advantage of the improved apparatus is that a single adapter suffices to enable the apparatus to properly process wider, narrower, longer or shorter webs, i.e., to receive differently dimensioned and/or configurated cassettes without necessitating a replacement of the feed table 1. Moreover, the seals (including the elements 7 and the advancing rolls 15, 16) are not affected by changes in the format of successively processed cassettes because the section 11 of the adapter housing need not be detached when a relatively large cassette is followed by a smaller cassette or vice versa.

The improved apparatus can comprise several adapters mounted on a common feed table which has several channels, one for each adapter. This is especially desirable in modern developing machines which are designed to simultaneously process two, three or more webs of photosensitive material. By utilizing two or more adapters above a single feed table with several channels or above discrete feed tables each of which has a single channel, the improved apparatus can simultaneously feed two or more webs of identical width or of two or more different widths. Moreover, the width of the web in any given path can be changed by the simple expedient of replacing an empty container in a selected adapter housing with a container for a supply of wider or narrower web stock. In other words, the attendant can convert the apparatus from simultaneous processing of several webs having a first width to simultaneous processing of several webs having a different second width or to simultaneous processing of several webs having different widths. The same applies for the length of webs, i.e., one of the adapters can receive a cassette for a substantial supply of convoluted photographic paper while another adapter housing contains a cassette for a smaller supply of photographic paper having the same width or a width which deviates from the width of the larger supply of paper.

The improved adapter can be installed in certain existing developing machines, either for mounting on a conventional feed table or in combination with a feed table of the type shown in FIG. 1.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

We claim:

1. In a machine for developing exposed phtotographic paper or like webs of photographic material which is stored in cassettes, apparatus for withdrawing webs from cassettes comprising a feed table having a channel for the passage of a web therethrough; means defining a chamber at one side of said table; and an adapter adjacent to the other side of said table, said adapter comprising a housing having an aperture communicating with said channel and defining a compartment for reception of different types of cassettes having different dimensions, and holding means for holding said different types of cassettes within said compartment in respective positions thereof relative to said aperture which are proper for withdrawal of the respective webs therefrom into said aperture, including two holding portions respectively situated at opposite sides of said aperture, at least one of said holding portions having a stepped configuration to form a plurality of recesses each of which has a width substantially corresponding to that of a region of a cassette of one of said different types which is received therein in the respective proper position.

2. The apparatus of claim 1, further comprising means for locating said housing with respect to said table in such position that said aperture registers with said channel.

3. The apparatus of claim 2, further comprising means for sealing said channel from said chamber, said housing including means for retracting said sealing means so as to permit a web to enter said chamber via said channel when said housing is engaged by said locating means.

4. The apparatus of claim 1, wherein said one side is the underside of said feed table.

5. The apparatus of claim 1, wherein said housing comprises a plurality of sections at least one of which is movable to and from an open position to permit insertion of a cassette into or removal of a cassette from said compartment.

6. The apparatus of claim 1, wherein said housing comprises a first section which is separably mounted on said feed table and a second section movable with respect to said first section between open and closed positions to respectively afford access to and to lighttightly seal said compartment, said aperture being provided in said first section.

7. The apparatus of claim 6, further comprising sealing means interposed between said first section and said feed table to prevent penetration of light from the area surrounding said first section into said aperture and said channel.

8. The apparatus of claim 6, further comprising means for centering said first section with respect to said feed table so as to maintain said aperture in register with said channel.

9. The apparatus of claim 6, further comprising retractible means for sealing said chamber against entry of light via said channel, said first section comprising means for maintaining said sealing means in retracted position in response to mounting of said first section on said feed table.

10. The apparatus of claim 6, wherein said other side is the upper side of said feed table and said first section is mounted on said feed table at a level below said second section.

11. The apparatus of claim 6, wherein at least one of said sections comprises means for preventing the pentration of light into said compartment in said closed position of said section section.

12. The apparatus of claim 1, wherein said adapter further comprises means for sealing said compartment from said aperture against the penetration of light from said compartment into said channel via said aperture.

13. The apparatus of claim 12, wherein said sealing means comprises a pair of web-advancing rolls mounted in said housing and having a nip adjacent said aperture.

14. The apparatus of claim 13, wherein said housing has recesses for portions of said advancing rolls.

15. The apparatus of claim 13, further comprising means for rotating one of said rolls in a first direction in response to rotation of the other of said rolls in the opposite direction.

16. The apparatus of claim 15, wherein said rotating means comprises a pair of mating gears one of which is coaxial with said one roll and the other of which is coaxial with said other roll.

17. The apparatus of claim 1, wherein said housing comprises a first section mounted on said feed table and a second section movable with respect to said first section between open and closed positions in which said compartment is respectively accessible and sealed against entry of light, said holding means being provided in said first section.

18. The apparatus of claim 1, wherein said holding means comprises several sets of spacedapart platforms, one set in each of said recesses and operative for supporting one of said types of differently dimensioned cassettes.

19. The apparatus of claim 1 for reception of cassettes wherein said regions have rounded end portions, at least one of said recesses being partly bounded by a concave cassette-contacting surface with a radius of curvature at least approximating that of the adjacent end portion of said region of the corresponding cassette.

20. The apparatus of claim 1, wherein the other of said holding portions also has a similarly stepped configuration to form an additional plurality of recesses arranged to respectively receive other regions of the respective cassettes of said different types.

* * * * *